US005429044A

United States Patent [19]

Giori et al.

[11] Patent Number: 5,429,044

[45] Date of Patent: Jul. 4, 1995

[54] SECURITY PRINTING MACHINE

[75] Inventors: Fausto Giori, Lausanne; Philippe Wyssmüller, Cheseaux, both of Switzerland

[73] Assignee: De La Rue Giori S.A., Lausanne, Switzerland

[21] Appl. No.: 222,842

[22] Filed: Apr. 5, 1994

[30] Foreign Application Priority Data

May 17, 1993 [CH] Switzerland ..... 1503/93

[51] Int. Cl.[6] ..... B41D 7/00

[52] U.S. Cl. ..... 101/33

[58] Field of Search ..... 101/45, 492, 487, 485, 101/489, 33, 34; 400/118

[56] References Cited

U.S. PATENT DOCUMENTS 4,202,637 5/1980 Tummolo ..... 400/118
4,369,082 1/1983 Kerwin ..... 101/34
5,271,644 12/1993 Merry et al. ..... 283/85

FOREIGN PATENT DOCUMENTS 0441596 8/1991 European Pat. Off. .
2104003 3/1983 United Kingdom ..... 101/492
9014953 12/1990 WIPO .
9209435 6/1992 WIPO ..... 101/492
9301057 1/1993 WIPO ..... 101/33

*Primary Examiner*—Eugene H. Eickholt
*Attorney, Agent, or Firm*—Kane, Dalsimer, Sullivan, Kurucz, Levy, Eisele and Richard

[57] ABSTRACT

Machine for security printing on security papers, especially bank notes, comprising a device (1) for feeding with paper, a device for transporting the paper and a unit (19) for applying optically variable images supported by at least one tape which is brought into contact with the paper such that these images are applied at defined locations on the paper corresponding to the printing marks on security papers. The application unit (19) includes at least one applicator cylinder (11) interacting with a pressure cylinder (20), the paper moving along between these cylinders. The tape is mounted between two reels arranged in a sector of the applicator cylinder (11) and the tape passes along a generatrix of said applicator cylinder, perpendicularly to the path of the paper, under the action of a servomotor acting intermittently at each application step.

15 Claims, 7 Drawing Sheets

SECURITY PRINTING MACHINE

FIELD OF THE INVENTION

The present invention relates to a machine for security printing on security papers, especially bank notes, including a device for feeding with paper, especially in the form of sheets, a device for transporting the paper and a unit for applying optically variable images supported by at least one tape which is brought into contact with the paper such that these images are applied at defined locations on the paper corresponding to the printing marks on security papers.

PRIOR ART

It is already known to incorporate, as a security area, optically variable images, in the form of film, on bank cards and also on security papers, in particular bank notes, so as to prevent the falsification of them, especially their reproduction by the use of photocopiers, the reproduction quality of which is increasingly improved. These optically variable images, including either a hologram or a cinegram, have the characteristic of changing appearance according to the angle at which they are observed. This image may be applied hot, for example to credit cards, or applied cold, in particular to bank notes.

Such a device as mentioned hereinabove is known from the publication EP-A 0,441,596 which describes especially a method and a device for the cold application of such an image to a bank note. According to this device, the paper, in the form of sheets, after having undergone a selective application of an adhesive ink at defined locations corresponding to the printing marks on the notes, and, after having moved along in front of a device for drying by ultraviolet radiation, pass into a unit for applying an optically variable image carried by a tape which is provided for each column of printing and which is unreeled between a pay-out reel mounted in a first cassette and a take-up reel mounted in a second cassette. The path between the two reels includes, in addition to the rolls and the guide and tension rollers, a cylinder provided with circumferential grooves, interrupted by bridges, said tape passing through said grooves. The sheets to be treated move along between said cylinder and a pressure cylinder and the transfer of an image takes place each time a bridge passes over the impression cylinder. The whole system is arranged such that the path of the tape is effected in the same direction of that of the sheets, but with a variable drive.

A device is also known, from the publication WO 90/14953, for transferring a thin sheet from a tape onto a paper web by making the tape pass between this web and a heating matrix which is mounted on a rotary cylinder. This cylinder, which carries the heating matrix or matrices, is driven in synchronism with said web, and the tape together with the thin sheets to be transferred move in a direction generally transverse to that of the web; said tape moves along between a pay-out cassette and a take-up cassette, the two cassettes being fastened laterally on either side of the rotary cylinder. In this installation, the paper web has to be pressed around a major part of the periphery of the cylinder in order that the heating time be sufficient and to allow the adhesion of the thin sheet on the paper web. This pressure is produced by means of at least two pressure bands which apply the paper web against half of the periphery of the cylinder and which simultaneously drive said cylinder in rotation.

SUMMARY OF THE INVENTION

The object of the present invention is to provide a machine which facilitates the system for applying the images, the path of the tape and its replacement, and which has a simpler structure ensuring correct register at the same time.

To this end, the machine according to the invention is distinguished by the characterizing clause of claim 1.

The advantages of this machine compared to the known devices are that, once the image has been applied to the paper, the applicator cylinder continuing to rotate, the tape, the path of which is perpendicular to the path of the paper, is released from the pressure cylinder and can be advanced and set into the position desired for the next application. The time of one complete rotation of the applicator cylinder is therefore available for setting a new portion of the tape, which is easily sufficient to ensure perfect register. Furthermore, the system for transporting the image-carrying tape, being built into the applicator cylinder, makes it possible to have a compact overall configuration.

According to a preferred embodiment of the invention, the tape is mounted in a single cassette comprising the two reels arranged in order to apply all the images simultaneously to a row of printing on the paper.

Preferably, the applicator cylinder includes a plurality of adjacent sectors each equipped with a cassette, which enables the images of a plurality of rows to be applied during one rotation of the applicator cylinder. In the preferred case of using the paper in the form of sheets, this makes it possible, upon each rotation of the applicator cylinder, to apply the images of a plurality of rows on the same sheet.

BRIEF DESCRIPTION OF THE DRAWINGS

The invention will be described, by way of non-limiting example for the treatment of the paper in the form of sheets, with reference to the appended drawings in which.

DESCRIPTION OF THE PREFERRED EMBODIMENT(S)

Figure 1:
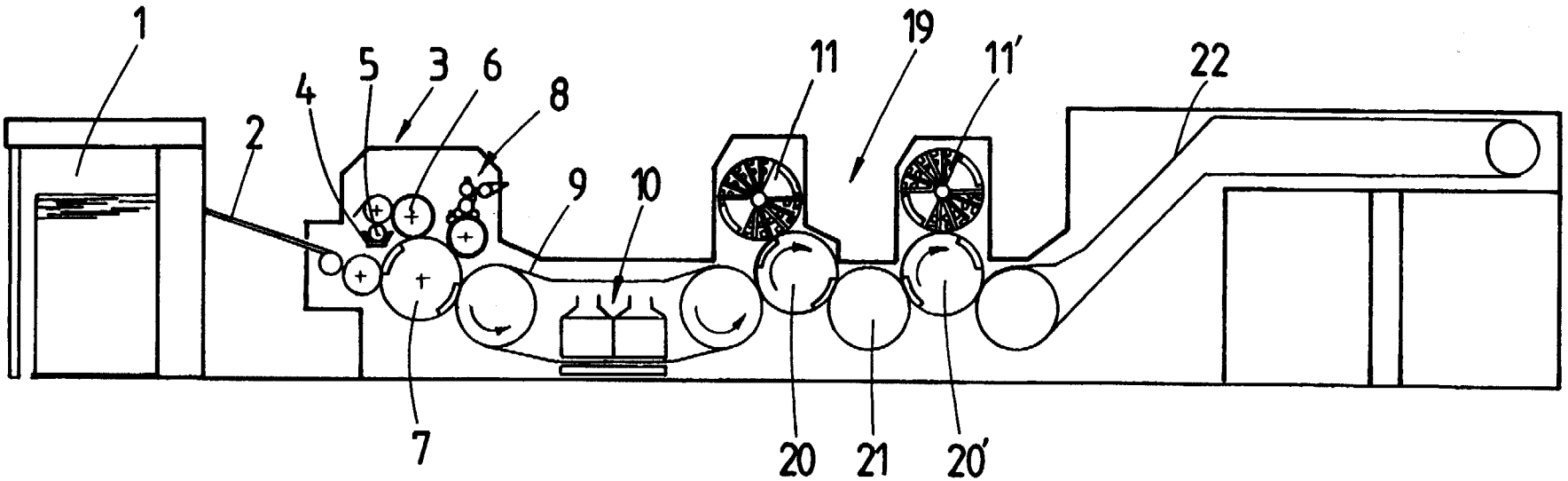
FIG. 1 represents a general view of a first embodiment of the security printing machine according to the invention.

Referring to FIG. 1, the security printing machine comprises a device 1 for feeding with sheets of security paper, in particular bank notes, this device consisting of a feeder. These sheets, which may or may not be already partially printed, are brought one by one by this feeder and a feedboard 2 to a unit 3 for applying a liquid adhesive so that the sheet receives an adhesive imprint at at least one defined location of each printing mark, or future printing mark, on the note. The printing marks provided on each sheet are arranged in N columns of X rows; by column is meant the series of printing marks in the direction of the transport of the sheets and by row is meant the series of printing marks in the direction perpendicular to the direction of the transport of the sheets. According to the example in question, N is equal to four, whereas X is equal to ten. This unit 3 is therefore designed in the manner of an inking unit, with a reservoir 4 in which is half-immersed a roller 5 which applies said liquid adhesive to a stencil-carrying roller 6 which selectively transfers, onto the sheet, the adhesive imprints at the defined locations, said sheet passing between said stencil-carrying roller 6 and an impression cylinder 7.

In the embodiment shown, this unit 3 also includes a device for applying a second security means, especially a letterpress unit 8 enabling a security image to be printed in a manner known per se.

The unit 3, 4, 5 for applying the adhesive could also be of another type, for example similar to a letter-press unit such as the unit 8.

The sheet is next taken up by a transfer system 9 which makes it pass in front of ultraviolet lamps 10 serving as catalyzer for the adhesive imprints, activating the adhesive. The time for the sheet to pass between the lamps 10 and the application of the image must lie between 3 and 10 s in order to prevent the adhesive from polymerizing.

The sheet next passes into a unit 19 for applying an optically variable image 12 in the form of film having, for example, the appearance of a patch and supported by a tape 13.

In the example represented in FIG. 1, this unit 19 includes two applicator cylinders 11, 11' mounted in series, each interacting with a pressure cylinder, respectively 20, 20', and a transfer cylinder 21.

The contact between the sheets to be treated and the applicator cylinder takes place only along a contact line, the width of which corresponds to the width of a row of images to be transferred and the guiding of the sheets is ensured by the pressure cylinder 20 around which the sheets are guided over a part of the periphery. Said pressure cylinder presses the sheets against the tape 13 installed on the periphery of the cylinder 20 and carrying the images so that these are transferred.

Figure 3:
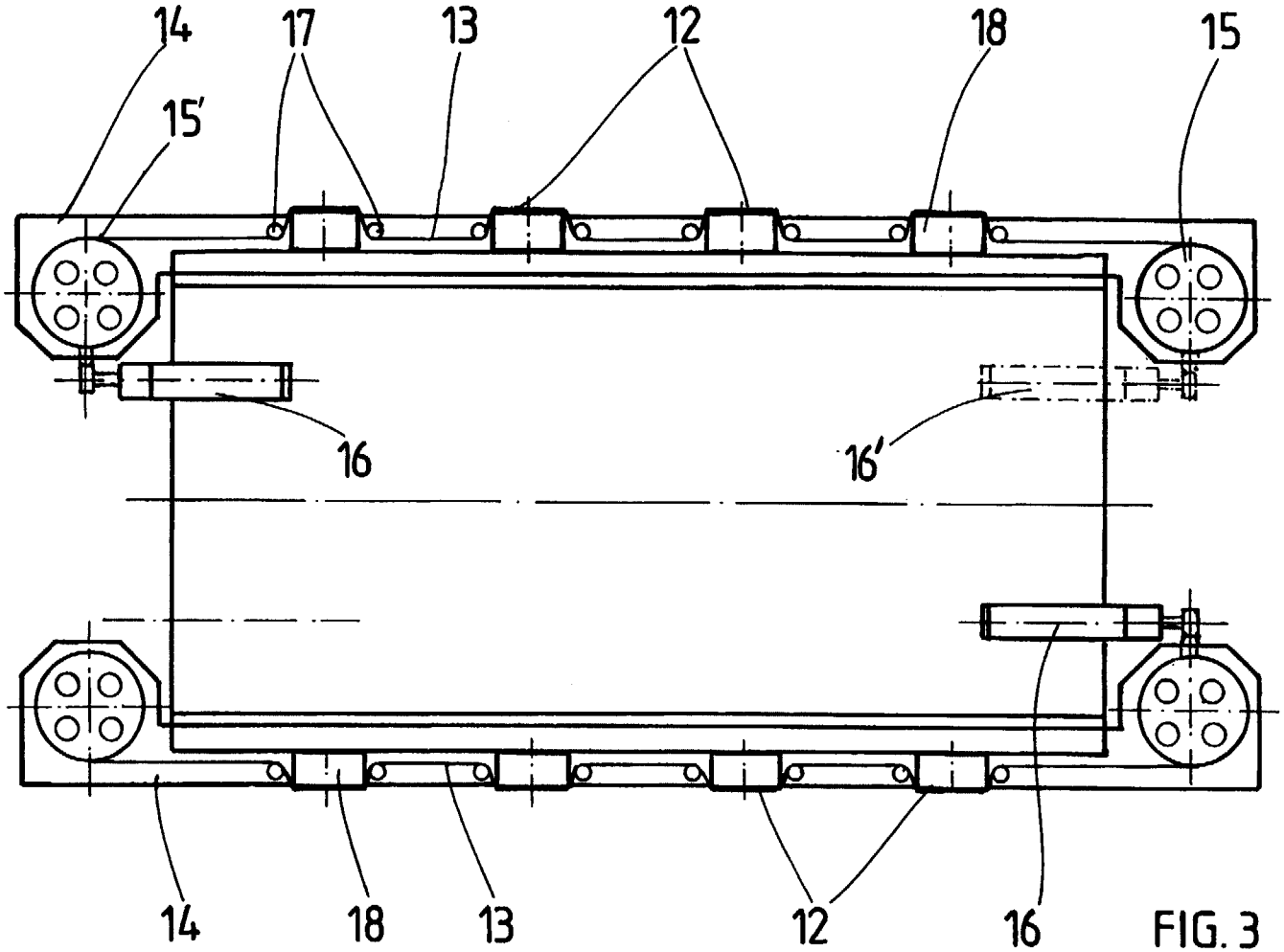
FIG. 3 is a side view of FIG. 2.
Figure 4:
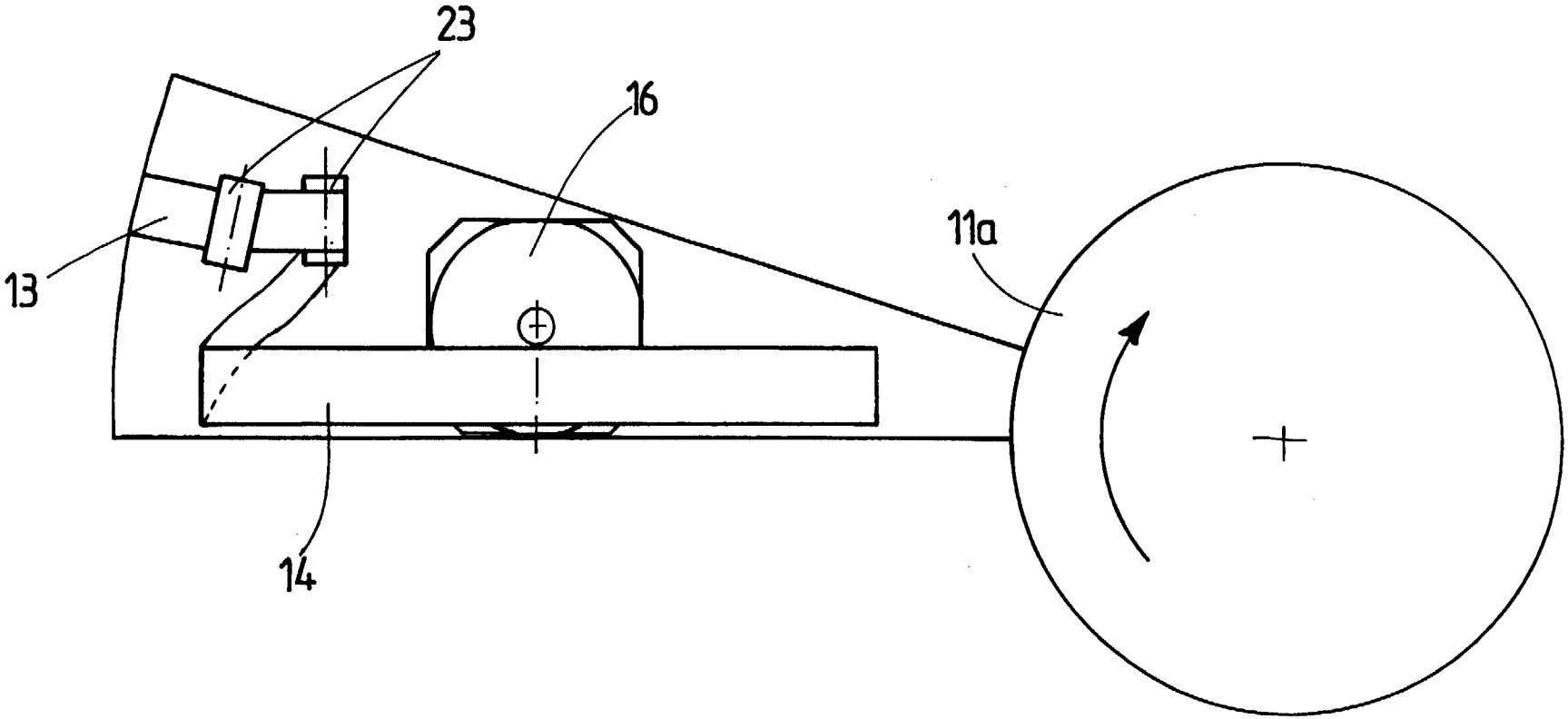
FIG. 4 is an enlarged view of an application sector of the applicator cylinder.

The device for applying the images 12 will now be described in more detail, with reference to FIGS. 2 to 4. The applicator cylinder 11 is designed to apply a series of X images 12 simultaneously, for example four, to the adhesive imprints on the sheet, that is to say to all the printing marks belonging to the same row of printing. Said images 12 are therefore arranged on the tape 13 at well-defined distances so that the image is applied to the sheets in the desired register. The adhesion between the images and the tape is achieved, for example, by means of wax. The tape 13 is itself mounted in a rigid cassette 14 comprising two reels 15, 15' between which it is paid out and the drive of the tape 13 is ensured by a servomotor 16 also serving to put the images 12 into register. The direction of pay-out of the tape 13 between the two reels of the cassette 14 is effected parallel to the axis of said cylinder 11, therefore perpendicularly to the movement of the sheets which pass between the applicator cylinder 11 and the pressure cylinder 20.

A second servomotor 16' may also be provided for the driving of the other reel so as to better regulate the holding and the tension of the tape. The supply leads of the servomotor, or alternatively the servomotors, pass inside the hollow spindle 11*a* of the cylinder 11, or alternatively the cylinders 11, as shown by the dot/dash lines in FIG. 3.

The useful length of the cassette corresponds to the length of the applicator cylinder 11, which length itself corresponds to the width of the sheets to be printed, that is to say to their dimension taken in the direction perpendicular to their movement.

In order to apply the images 12 to all the printing marks of the same column on a sheet (ten in the example in question), the cassettes 14 have been mounted in sectors distributed in groups of five on each cylinder 11, 11'; thus, the first cylinder 11 applies the images of the odd rows on the sheet, whereas the images of the even rows are applied by the second cylinder 11', this being done to avoid too dense an arrangement of the sectors.

The cassettes may be arbitrarily distributed between the two cylinders 11, 11' on condition that the sum of the number of cassettes of the first cylinder and the number of cassettes of the second cylinder is equal to the number X of rows of printing per sheet.

Figure 2:
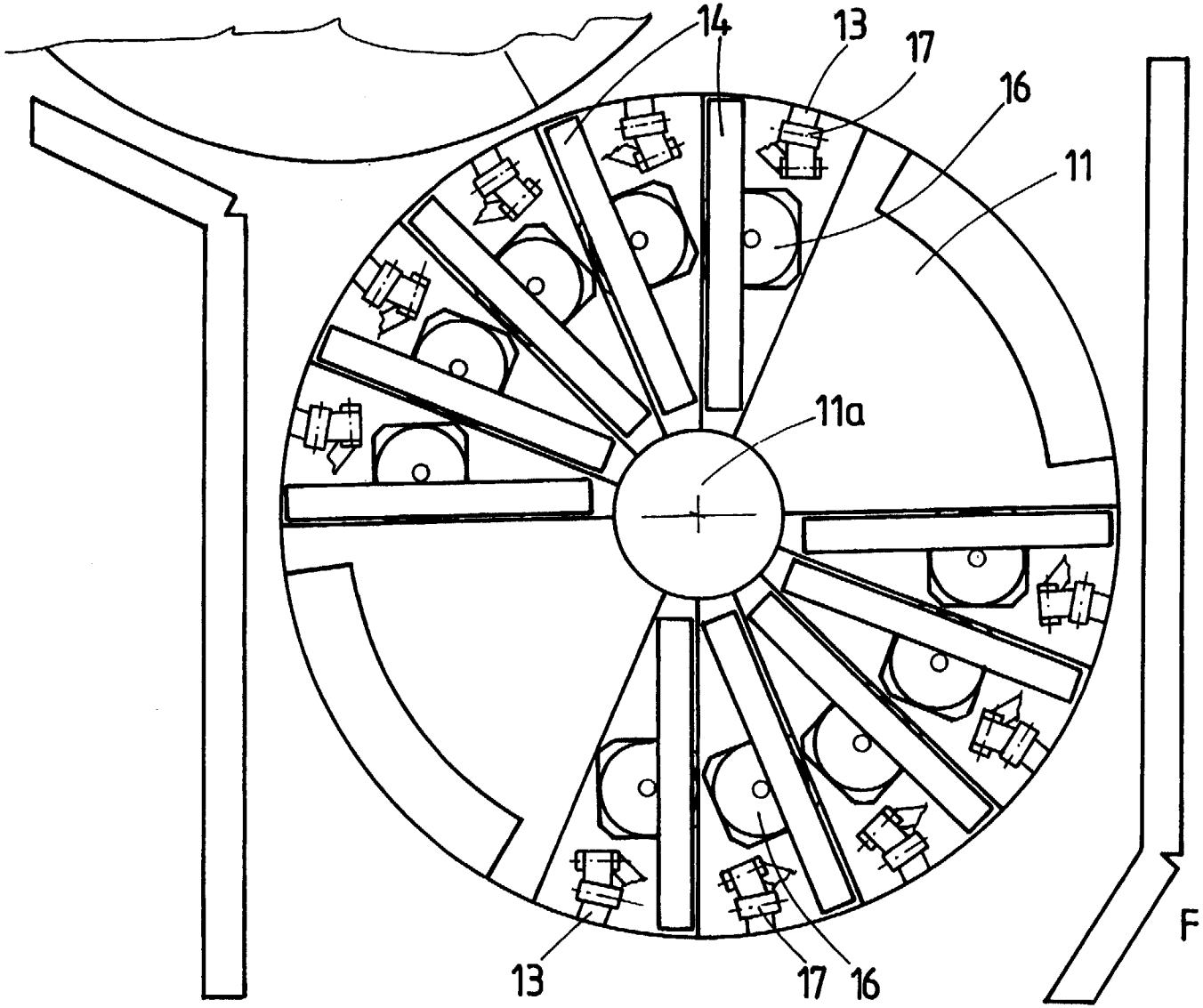
FIG. 2 represents an end view of the applicator cylinder.

In the example represented in FIG. 2, each applicator cylinder 11, 11' includes two groups of five cassettes 14 distributed over two diametrally opposed sectors, one complete rotation of the cylinders 11, 11' enabling thereafter all the images to be applied to two consecutive sheets. The cassettes 14 are fitted onto the cylinder 11 (FIG. 3) so that the free part between the two reels 15, 15' is applied along one generatrix of the applicator cylinder 11. The cassette 14 is furthermore provided, facing said generatrices, with pads 18 over which passes the tape 13 which is paid out from the reel 15 by being guided by tensioning rolls 23. These pads 18 can be adjusted axially as a function of the separation between two successive images and therefore of the number of printing marks provided per row on the sheet, and can also be adjusted in the radial direction; these pads therefore enable, on the one hand, the images to be positioned and, on the other hand, a sufficient pressure of the image 12 on the sheet to be provided during the application. Tensioning rolls 17 tension the tape 13 between two pads 18, as is also seen in FIG. 4.

The length of the tape 13 between the two reels 15, 15' is a function of the size of the images 12 applied, of the number of pads 18 per tape and of the distance between two pads 18.

The cassettes are made up beforehand as a function of the characteristics of the sheets to be printed. For example, if, as in the example represented, the sheet to be printed includes ten rows of four columns of printing on bank notes, the cassette is designed to apply four images simultaneously to the same row during the forward movement of the sheets.

The applicator cylinders rotate continuously with the machine and the relative speeds of the cylinders are such that the first applicator cylinder 11 lays down the images 12 onto the imprints of one row in two on the sheet which advances, the intermediate rows of images being laid down by the second cylinder 11'. The compressive force between the applicator cylinder 11, 11' and the pressure cylinder 20, 20' is relatively low, for example of the order of 300 g/cm$^2$, the adhesion, by the wax, of the image 12 on the tape 13 itself being not very high.

As already mentioned, the pay-out of the tape from each cassette is achieved by a servomotor 16, the set of these being connected to the center of the cylinder 11 and passing through the spindle. The servomotors 16 are actuated intermittently in order to pay out the tape between two applications, while all the other elements of the machine work continuously. When the sector of the applicator cylinder 11 is in the application position, that is to say opposite the row of adhesive imprint on the sheet, the tape 13, together with the images 12, are stationary, the servomotor 16 serving only to preserve the register. Once the row of N images has been laid down onto the sheet, while the applicator cylinder 11 continues its rotation, the servomotor is actuated in order to pay out a new portion of tape 13 with new images. During one complete rotation of the applicator cylinder 11, a sufficient time is available for actuating the servomotor for the purpose of the paying-out of the new portion of tape and for putting the new images into register.

At the output of the unit 19 for applying the images, the sheets are taken up by an output system 22 which conveys them to the other printing steps. The application of the optically variable film images is preferably effected before the printing of the notes on the sheet, so that said image itself can receive, at least partially, a printing mark, which increases the security.

Figure 5:
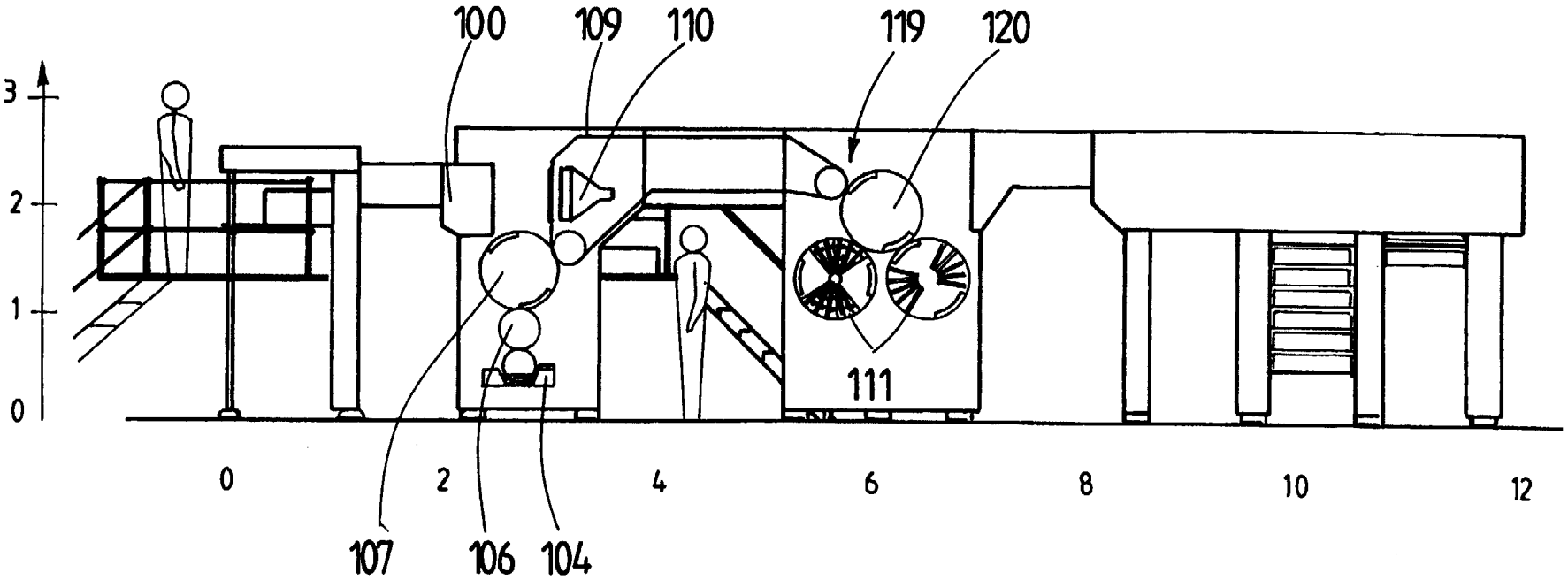
FIG. 5 represents a general view of a second embodiment of the machine.
Figure 6:
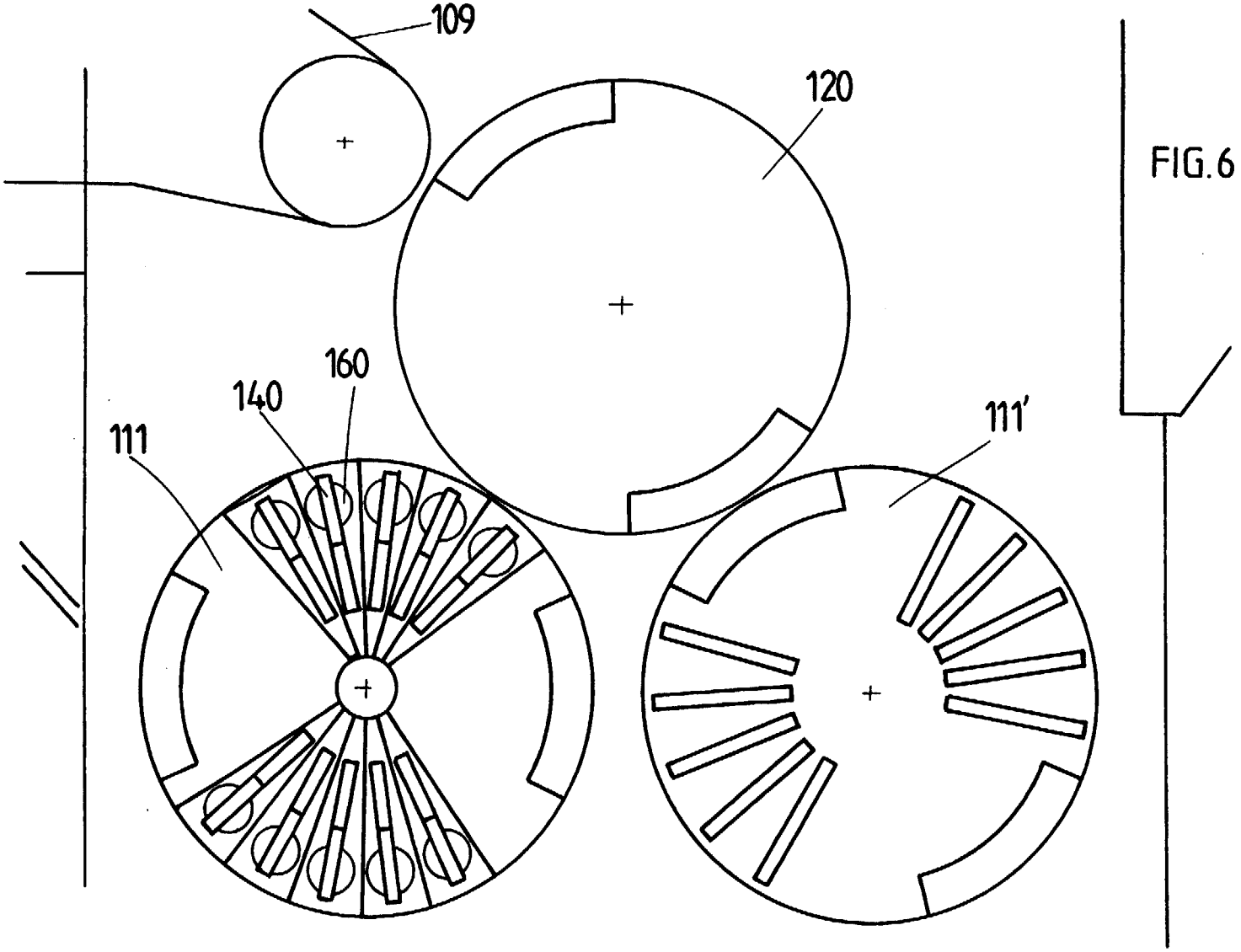
FIG. 6 is a view of the application unit of the machine according to FIG. 5.

FIGS. 5 and 6 represent an alternative embodiment of the machine, showing a different arrangement of the various parts. The sheets arriving from a feed device 101 are taken by an impression cylinder 107 on which they receive, at the predetermined locations, adhesive imprints coming from the reservoir 104, by means of a stencil roll 106. Next, they pass directly onto a transfer system 109 making them move vertically along in front of an ultraviolet lamp 110 and next conveying them to the unit 119 for applying the images. This unit 119 comprises, contrary to the previous example, a single pressure cylinder 120 interacting directly with two applicator cylinders 111, 111'. The cylinders 111, 111' are each provided with ten cassettes 140 distributed over two sectors and acting, alternately, on the sheet which passes between them and the pressure cylinder 120.

Figure 7:
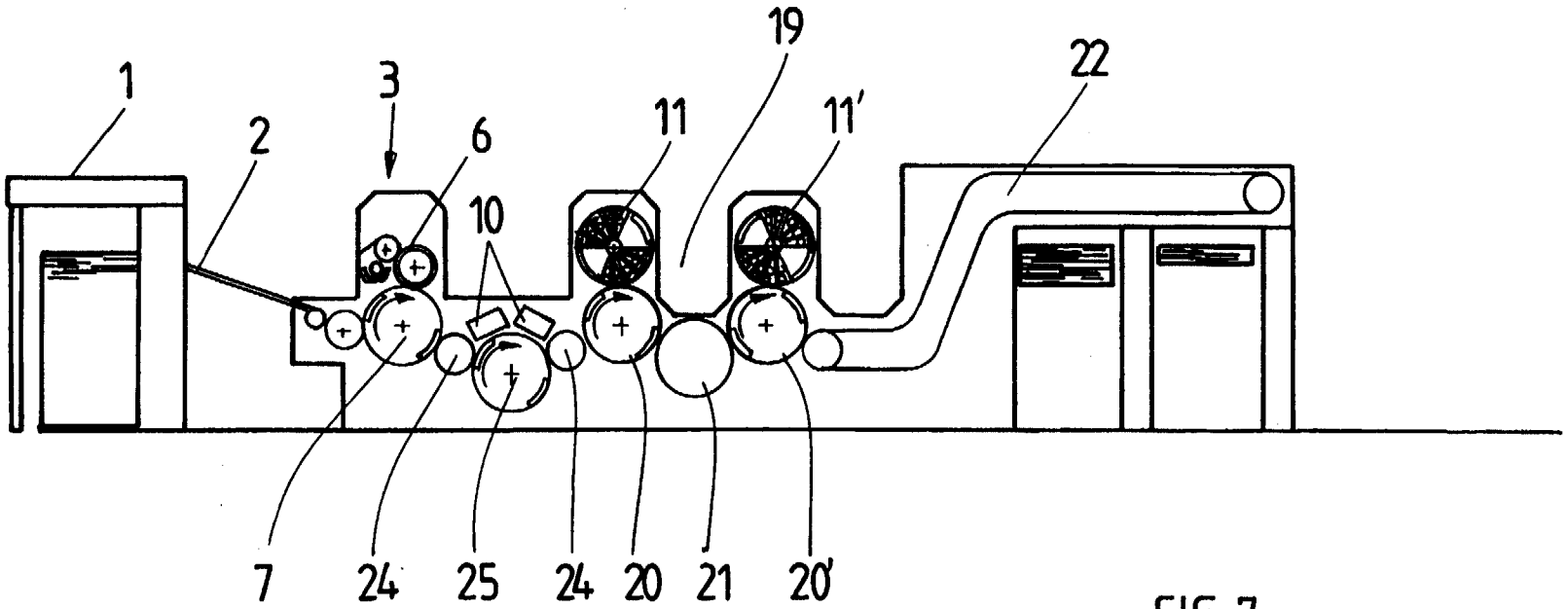
FIG. 7 represents a general view of a third embodiment of the machine.

FIG. 7 represents a third embodiment of the machine, which differs from the installation according to FIG. 1 only by the installation for transferring the sheets, which comprises, not a transfer system 9, but transfer rolls, namely two transport rolls 24 arranged on either side of a drying cylinder 25 around the periphery of which are the ultraviolet lamps 10. All the other elements are not described again, since they bear the same references as those of the first embodiment and correspond to them. The unit 3 for applying the adhesive is, in this case, simplified, since it does not include a letterpress unit.

It could also be envisaged using a two-component adhesive, one being applied by the application unit 3, as described in relation to FIG. 1, the other being already applied to the background of the optically variable images, the two components once pressed against each other becoming active, like two-component adhesives, which would dispense with the station for passing beneath the ultraviolet lamps.

The invention is not limited to the embodiments described, and other variants could be envisaged without departing from the scope of the invention, especially as regards the device for transferring the sheets, the device for applying the adhesive, the structure of the cassettes and their installation in the applicator cylinder. The arrangement of the cassettes on the applicator cylinder could also be different, especially, instead of being mounted inside the sector, the cassette could extend beyond the latter laterally on one or both sides of the cylinder, and/or extend in the diametral direction, that is to say that the cassette extends, in the radial direction, beyond the line of the spindle of the cylinder. The device which has just been described is also applicable to a web fed printing machine.

We claim:

1. A machine for security printing on security papers, having printed marks including a device for feeding with paper, especially in the form of sheets (1), a device for transporting the paper and a unit (19) for applying optically variable images (12) supported by at least one tape (13) which is brought into contact with the paper, such that these images are applied by an application unit (19) at defined locations on the paper corresponding to the printing marks on security papers, wherein the application unit (19) includes at least one applicator cylinder (11) interacting with a pressure cylinder (20), the paper moving along between said cylinders (20), wherein said tape (13) is mounted between two reels (15, 15') fixed to the applicator cylinder (11) and wherein the tape passes along a generatrix of said applicator cylinder, perpendicularly to the path of the paper, under the action of a servomotor acting intermittently at each application step.

2. The machine as claimed in claim 1, wherein said tape (13) is mounted in a single cassette (14) comprising the two reels, at least the major part of said cassette (14) being arranged inside said applicator cylinder (11), the useful length of the cassette corresponding to the length of the applicator cylinder (11) which, itself, corresponds to the width of the paper to be printed, that is to say to their dimension taken in the direction perpendicular to their movement.

3. The machine as claimed in claim 2, wherein the cassette (14) is arranged inside a sector of the applicator cylinder (11).

4. The machine as claimed in claim 2, wherein the major part of the cassette (14) is arranged inside a sector of the applicator cylinder (11) and extends beyond said cylinder laterally on at least one side.

5. The machine as claimed in claim 2, wherein the applicator cylinder (11) includes a plurality of adjacent sectors each equipped with a cassette (14).

6. The machine as claimed in claim 5, wherein, in the case of use of the paper in the form of sheets on which the printing marks on security papers are arranged in columns and rows, the number of sectors corresponds to the number of rows of printing per sheet.

7. The machine as claimed in claim 6, wherein two applicator cylinders (11, 11') are provided, mounted in series and acting alternately on the same sheet, the number of sectors and of cassettes of each cylinder being such that the sum of the two numbers is equal to the number of rows of printing per sheet.

8. The machine as claimed in claim 6, wherein the cassettes are set in pairs in diametrally opposed sectors of said applicator cylinder (11) and apply alternately, after one half-revolution of said applicator cylinder, a series of images (12) to a row of printing on two successive sheets.

9. The machine as claimed in claim 1, wherein, upstream of the unit (19) for applying the image, there is provided a unit (3) for applying adhesive imprints to the paper at locations intended to receive said image (12), followed by a drying device.

10. The machine as claimed in claim 9, wherein the adhesive is a two-component adhesive, one component being applied by said application unit (3), whereas the second component is on the background of said image (12).

11. The machine as claimed in claim 9, wherein the unit (3) for applying the adhesive furthermore comprises a printing unit enabling a security image to be printed, the two units having a common impression cylinder (7).

12. The machine as claimed in claim 2, wherein the major part of the cassette (14) is arranged inside a sector of the applicator cylinder (11) and extends beyond said cylinder diametrally on at least one side.

13. The machine as claimed in claim 9, wherein unit (3) is followed by a drying device.

14. The machine as claimed in claim 13, wherein the drying device is provided with ultraviolet means.

15. The machine as claimed in claim 11, wherein the printing unit of unit (3) is a letter press unit (8).

* * * * *